US011584607B2

(12) United States Patent
Ludgate et al.

(10) Patent No.: US 11,584,607 B2
(45) Date of Patent: Feb. 21, 2023

(54) DYNAMIC GRADUATED MEDIA COLLATION SYSTEM

(71) Applicant: XEROX CORPORATION, Norwalk, CT (US)

(72) Inventors: Gregory A Ludgate, Williamson, NY (US); Douglas K Herrmann, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 201 days.

(21) Appl. No.: 17/117,595

(22) Filed: Dec. 10, 2020

(65) Prior Publication Data

US 2022/0185614 A1 Jun. 16, 2022

(51) Int. Cl.
*B65H 39/06* (2006.01)
*B65H 39/115* (2006.01)

(52) U.S. Cl.
CPC ..... *B65H 39/115* (2013.01)

(58) Field of Classification Search
CPC ..... B65H 39/115; B65H 39/06; B65H 39/043
USPC ..... 414/791
See application file for complete search history.

(56) References Cited

U.S. PATENT DOCUMENTS 2,831,585 A * 4/1958 Patrick ..... B65G 57/32 414/794.7
2,831,586 A * 4/1958 Patrick ..... B65B 35/50 414/794.7
3,220,158 A * 11/1965 Roser ..... B65B 5/06 414/794.7
3,297,174 A * 1/1967 Letchworth ..... B65H 15/02 414/791
3,712,186 A * 1/1973 Lulie ..... B65H 31/34 414/794.9
9,463,945 B2 10/2016 Herrmann
9,463,946 B2 10/2016 Herrmann
9,527,693 B2 12/2016 Herrmann

FOREIGN PATENT DOCUMENTS

GB 2197298 A * 5/1988 ..... B65H 39/043
WO WO-9302003 A1 * 2/1993 ..... B65G 57/32

* cited by examiner

*Primary Examiner* — Patrick H Mackey
(74) *Attorney, Agent, or Firm* — William A. Henry, II

(57) ABSTRACT

A system for collating and stacking long cut retail edge marker strips exiting a roll fed high speed slitter/perforator/cutter apparatus includes a media collation apparatus that facilitates automated collation of the long retail edge marker strips by collecting them off a surface and through the use of a device of graduated stair configuration separately lifting the retail edge markers from the surface for downstream accumulation. Individual bundles of slit retail edge marker strips are moved in a cross-process direction on integrated shelves of the media collection apparatus by a connected pusher. This allows the bundles to be transferred through the cross-process move in separate bundles before being collated at the end of the move when the pusher retracts to drop the bundles onto a receiving platform.

17 Claims, 6 Drawing Sheets

DYNAMIC GRADUATED MEDIA COLLATION SYSTEM

CROSS REFERENCE TO RELATED APPLICATIONS

Cross-referenced and included herein by reference is commonly assigned U.S. application Ser. No. 16/727,279, Docket No. 20190580US01, filed Dec. 26, 2019 and entitled RETAIL EDGE MARKER ACCUMULATION AND COLLECTION SYSTEM by Gregory A. Ludgate et al.

BACKGROUND

The presently disclosed embodiment is directed to providing a collation system, and more particularly, to a collation system that facilitates automated collation of long shelf edge marker strips.

Retail stores often utilize edge markers to convey information regarding products offered for sale, e.g., product costs, unit cost, sale pricing, etc. Such markers must be updated and/or replaced on a periodic basis. For example, regular product pricing may change, or during a sale, a discounted price may be necessary. Changes to edge markers may be required for hundreds or even thousands of products and these changes may be required daily weekly or another periodic term. In addition, product placement may change which would require updating of the edge markers. In some states, it is critical that the edge markers be updated in a timely fashion as the retail store may be obligated to honor the price displayed adjacent the product. In other words, if the store fails to remove the edge marker that displays a discounted cost, the store must charge that cost if a customer relies upon that price when making a purchase selection. In view of the foregoing, it should be apparent that proper timing and placement of edge markers is a critical responsibility of a retail store.

Although some retail chain stores share common store layouts, also known as a store planogram, most retail locations, even within a chain store have unique store planograms. The changeover of store signage can incur significant time which in turn incurs significant cost. A common practice is to print sheets of edge marker strips and an employee or group of employees are tasked with edge marker changeover. These methods include various deficiencies, e.g. edge marker strips compiled out of order or not matched to the store planogram, sheets that require further separation of individual store departments, etc. These methods are quite costly and presently, in at least one instance, requires for example, 20 people employed to individually catch and collate each sheet of edge markers. Other media collating systems including U.S. Pat. Nos. 9,463,945 B2, 9,463,946 B2 and 9,527,693 B2, are known, but the heretofore-mentioned problems persist.

An improvement to prior collating systems is disclosed in aforementioned U.S. application Ser. No. 16/727,279 that includes a system for manually collating retail edge marker strips in lengths of 48 inches to 60 inches in varying widths. This manual system is made up of four angled accumulation bins with pushers that are pulled in a cross-process direction by hand to move the retail edge marker strips consecutively from one bin to the next to build a stack. Manual system operator involvement is required to make all of the cross-process moves for collation with a handle connected to the pushers to individually collate the retail edge marker strips for each store to a stacking location to form either a subset bundle or a full store bundle of retail edge marker strips.

However, there is still a need for a more efficient shelf edge marker collation system that rapidly presents shelf edge markers to store employees in a per store planogram order for in-store deployment.

SUMMARY

Accordingly, in answer to this need, disclosed herein is a graduated or stair shaped media collation system that allows for the automated collation of long retail edge marker strips by collecting them off a flat or angled surface and using a device of graduated or stair configuration to separately lift the retail edge markers for downstream accumulation. Individual bundles of slit retail edge marker strips are able to be moved in a cross-process direction on integrated shelves by a connected pusher. This allows the bundles to be transferred through the cross-process move in separate bundles before being collated at the end of the move when the pusher retracts to drop the bundles.

BRIEF DESCRIPTION OF THE DRAWINGS

Various of the above-mentioned and further features and advantages will be apparent to those skilled in the art from the specific article or methods described in the example(s) below, and the claims. Thus, they will be better understood from this description of these specific embodiment(s), including the drawing figures (which are approximately to scale) wherein:

DETAILED DESCRIPTION OF THE PREFERRED EMBODIMENT

Figure 1:
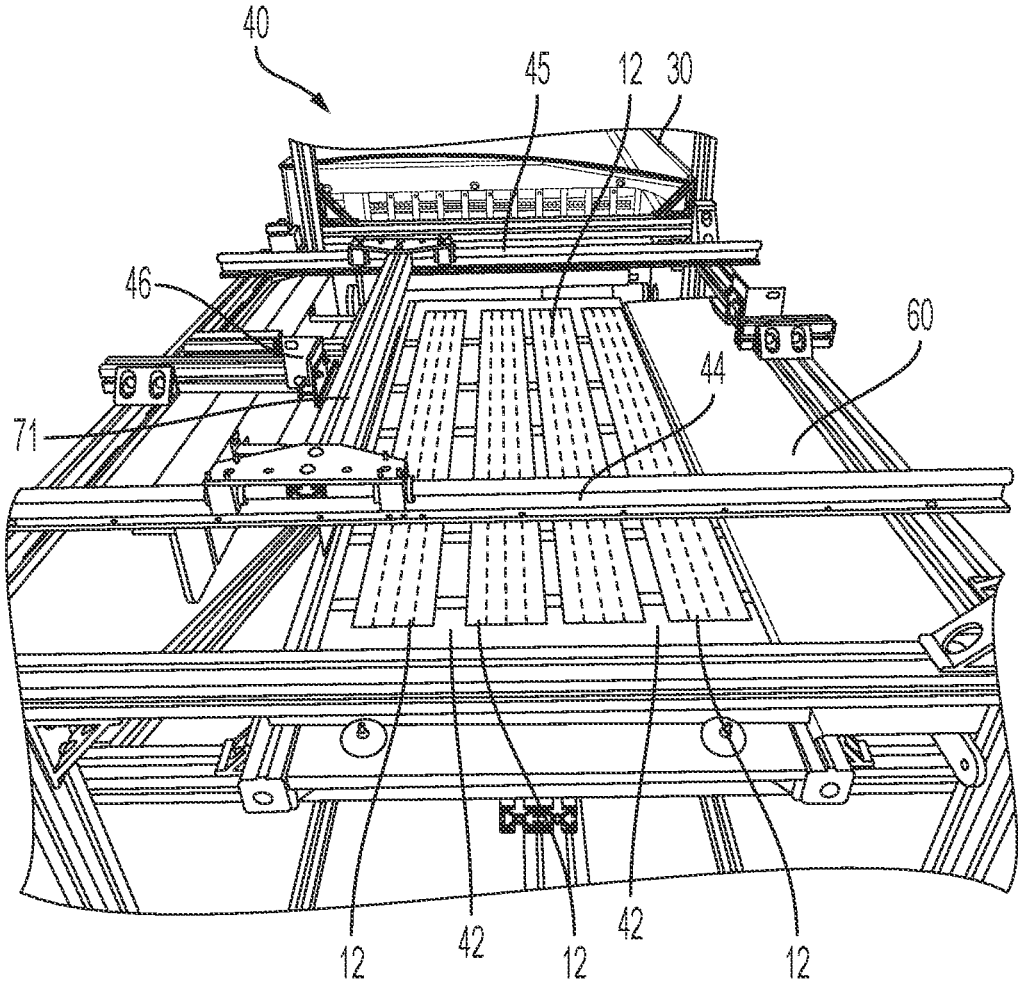
FIG. 1 is partial end view of a graduated media collation system in accordance with the present disclosure connected to a perforator/slitter/cutter.

For a general understanding of the features of the disclosure, reference is made to the drawings. In the drawings, like reference numerals have been used throughout to identify identical elements.

Currently, there is a system for outputting printed shelf edge markers from a conventional unwinder that roll feeds edge markers in continuous sheet form into a conventional perforator/slitter/cutter that slits and cuts the continuous roll fed sheet of shelf retail edge markers into extended predetermined lengths of, e.g., 4 feet to 5 feet. Each predetermined sheet length is slit into four separate and individual strips and each individual strip is perforated into four different parallel sections to accommodate different in-store shelf requirements. While this system feeds roll stock and cuts and perforates the stock, it does not include a system for accumulating and collating in-store shelf edge marker strips exiting the system.

In accordance with the present disclosure, a graduated media collection system 40 is disclosed in FIG. 1 that fits together with and directly after a perforator/slitter/cutter 30 of a continuous roll feed system (not shown) which converts the edge marker roll into perforated and cut strips 12 and includes a flat baffle 42 that accepts the slit retail edge marker strips 12 from the perforator/slitter/cutter 30 and accumulates them into bundles as they exit perforator/slitter/cutter 30. Flat baffle 42, which could be angled to include bins if desired, is configured to allow retail edge marker strips 12 exiting perforator/slitter/cutter 30 to settle into four separate sets for later movement onto an accumulation station or stacking platform 60. Graduated media collection system 40 includes rails 44 and 45 that support an automated self-pusher mechanism 46 which is configured to move the retail edge marker strips 12 transversely and transport them collated onto stacking platform 60.

Figure 2:
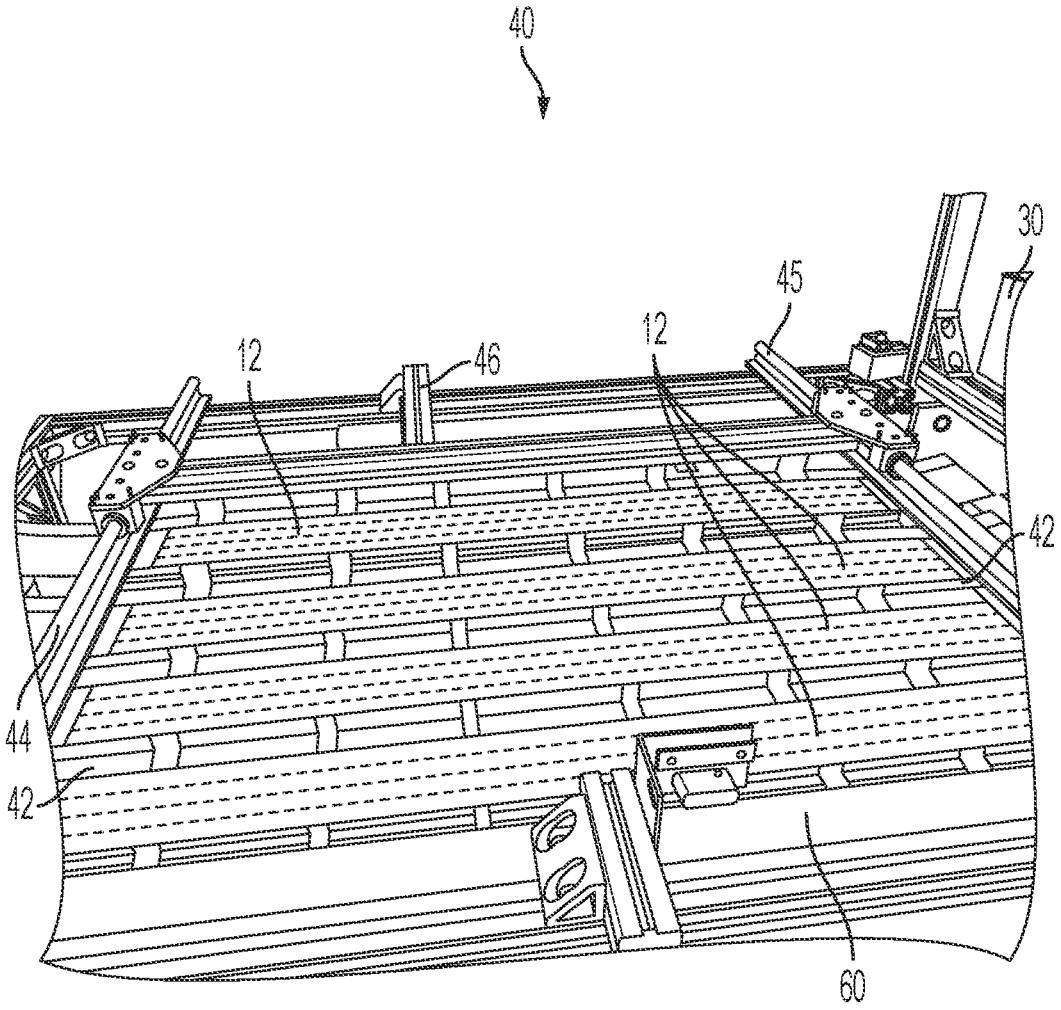
FIG. 2 is a partial side perspective view of the graduated media collation system of FIG. 1 showing slit edge bundles of marker strips collated on a flat baffle.

As shown in FIGS. 1 and 2 flat baffle 42 receives four separate marker strips slit from perforator/slitter/cutter 30 that are conveyed onto flat baffle 42.

Figure 3:
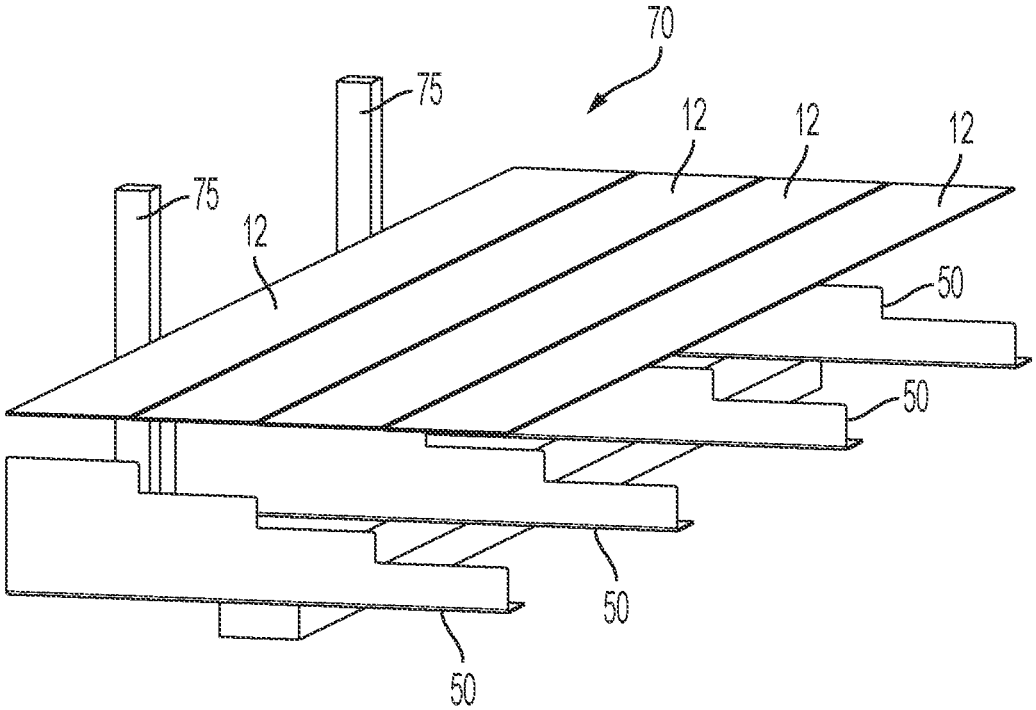
FIG. 3 is a partial orthogonal view of the system architecture of FIG. 2 showing how the slit edge strips align with graduated stepped plates.
Figure 4:
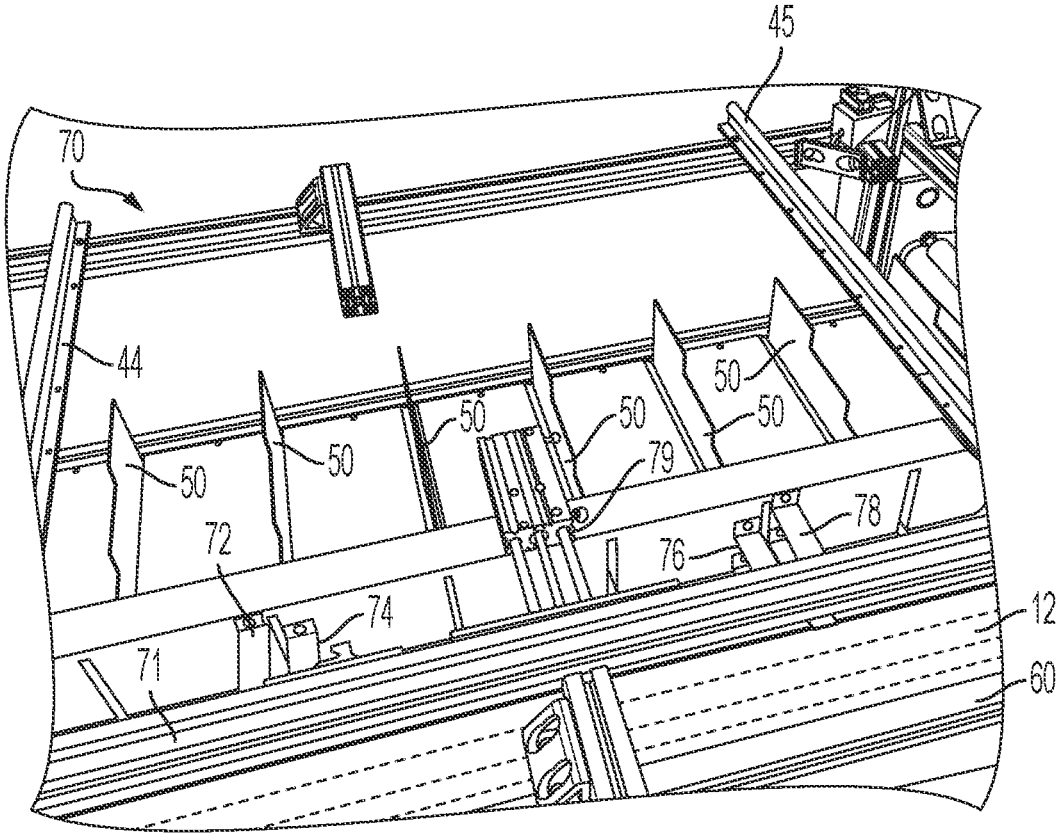
FIG. 4 is a partial orthogonal view showing graduated stepped plates and slit edge marker strips accumulated on a stacking platform.
Figure 5:
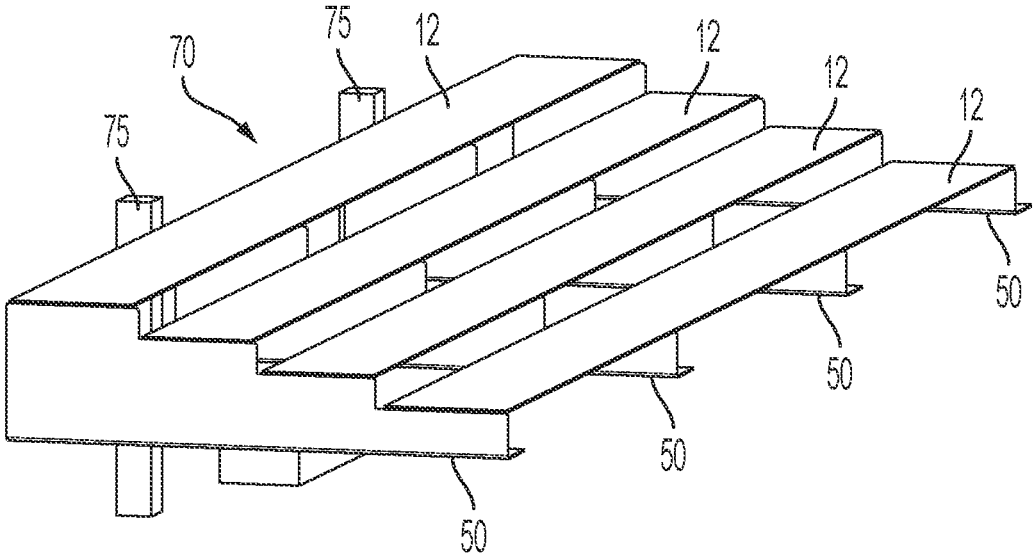
FIG. 5 is a partial orthogonal view of the graduated media collation system of FIG. 2 showing slit edge bundles of marker strips collated and supported on raised graduated/step lift plates.
Figure 6:
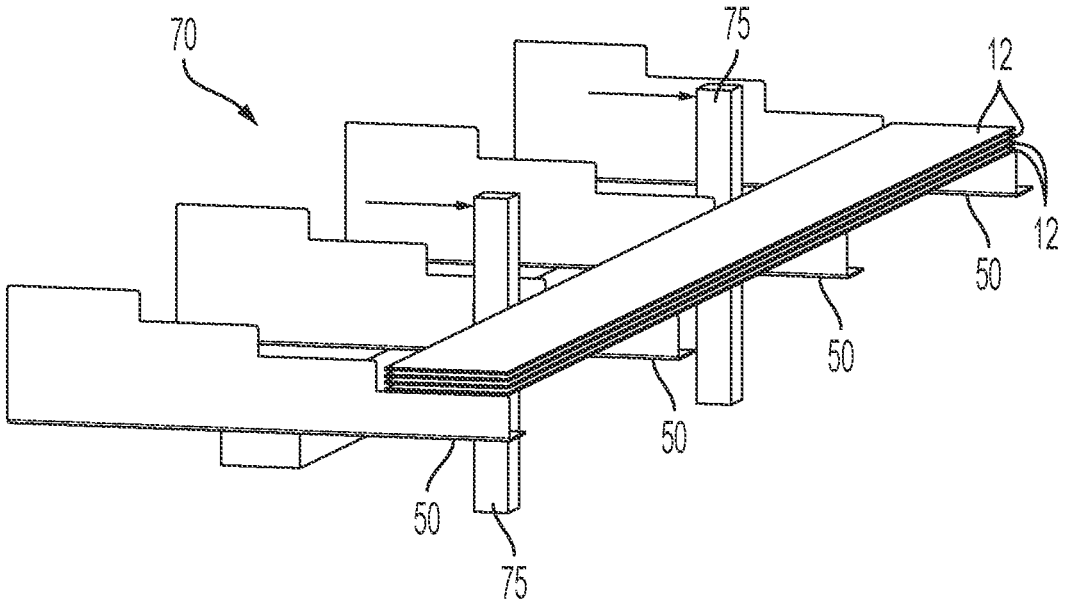
FIG. 6 is a partial schematic orthogonal view of the graduated media collation system in FIG. 5 showing slit retail edge marker strips having been moved collated by automated pushers away from the graduated stepped plates.

All of the marker strips of a job or part of a job conveyed from perforator/slitter/cutter 30 settle into separate sets on baffle 42. Afterwards graduated stepped plates or lift guides 50 shown in FIGS. 3 and 4 are actuated to lift the slit edge marker strips from baffle 42 to a point where they will now be held at different heights as shown in FIG. 5. By having the slit edge marker strips at different heights, the slit edge marker strips are separated and then can be accumulated into a final stack through an automated cross process push. The next step is for the automated horizontal pusher system 70 to move upstanding members 75 cross process and collate the groups of strips into a collated stack as shown in FIG. 6.

Pusher system 70 in FIG. 4 includes a pusher 71 and integrated shelves, for example, top shelf, left side 72, bottom shelf, left side 74, bottom shelf, right side 76 and top shelf right side 78 that correspond to each of the steps/graduations of lift guides 50 that gather the slit edge marker strips into groups. Actuation of shelf push actuator 79 enables pusher 71 to move the slit edge marker strips cross process to a position above stacking platform 60. That is, at the end of a push the slit edge marker strips are held on each of the shelves now one on top of the other. An additional conventional actuator which is part of pusher system 70 is then triggered and the shelves are retracted, and the sets or bundles of slit edge marker strips are dropped into one collated pile on stacking platform 60 at the end of the cross process move.

In FIG. 3 automated horizontal pusher system 70 depicts how slit edge marker strips 12 align with the graduated or stepped plates 50. Graduated or stepped plates 50 are shown in a down position below baffle 42 of FIG. 2 and the integrated shelves of FIG. 4 (both not shown) while edge marker strips 12 are collected in sets on baffle 42 (not shown) as shown in FIG. 3. Graduated or stepped plates 50 are shown in an up position in FIG. 5 above the baffle (not shown) lifting the slit edge marker strips 12 into a second position separating the slit edge marker strips 12 into different heights to be pushed from left to right as individual bundles by pusher 71 of pusher system 70. FIG. 6 shows slit edge marker strips 12 having been moved collated by automated pusher 71 away from the graduated stepped plates 50 to a position above the stacking platform 60. Individual bundles of slit edge marker strips are moved in the cross-process direction facilitated by the integrated shelves of the pushers. This allows the bundles to be transferred in order through the cross process move in separate bundles before being collated at the end of the move when the pusher 71 retracts to drop the bundles onto platform 60. Throughout the process of moving the bundles horizontal pusher system 70 allows for the transfer of long media or product strips in a media collation system where the individual bundles of media remain separate until the final stacking operation. A foot switch or trigger can be incorporated into the media collation system to automatically collate sheets based on job and set parameters.

It should be understood that an automatic collating system that can automatically collate shelf markers based on job parameters has been disclosed which collates retail edge markers that have been cut from a high speed continuous feed roll and allowed to fall directly onto a baffle. The automatic collating system enables automated collation of the long shelf edge marker strips by collecting them on a flat or angled surface and using a device of graduated stair configuration to separately lift the edge markers for downstream accumulation. Individual bundles of slit strips are able to be moved in the cross-process direction on integrated shelves of the pusher. This allows the bundles to be transferred through a cross-process move in separate bundles before being collated at the end of the move when the pusher retracts to drop the bundles.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A media collating system for collating media strips exiting a source, comprising:

a baffle configured to receive said media strips from said source and position them thereon in individual bundles;

step configured lift guides adapted to lift each of said individual bundles of media strips to predetermined heights above said baffle;

at least one pusher configured for movement orthogonally to said baffle immediately after said individual bundles of media strips have been positioned above said baffle by said step configured lift guides to thereby move said individual bundles of media strips off said step configured lift guides;

a collection station adapted to receive said individual bundles of media strips from said at least one pusher collated after said at least one pusher has been removed from beneath said individual bundles of media strips resulting in said individual bundles of media strips being dropped in one collated pile into said collection station; and wherein said at least one pusher includes shelves at the same height of said step configured lift guides to accumulate each individual bundles of said media strips for movement to said collection station.

2. The media collating system of claim 1, wherein said baffle is flat.

3. The media collating system of claim 1, wherein said baffle is angled.

4. The media collating system of claim 1, including an actuator connected to said pusher shelves in order to move individual bundles of media strips to said collection station and subsequently retract to drop said individual bundles of media strips to form a composite collated stack at said collection station.

5. The media collating system of claim 4, wherein said individual bundles of media strips are collected in aisle order.

6. The media collating system of claim 1, wherein at the end of movement of said individual bundles of media strips by said at least one pusher said individual bundles of media strips are instantaneously held one above the other over said collection station for a period of time before retracting of said at least one pusher occurs to allow said individual bundles of media to drop to said collection station.

7. The media collating system of claim 1, wherein said individual bundles of media strips are each held by said step configured lift guides at different heights above said baffle.

8. A collating system for collating retail edge markers exiting a source, comprising:

a support member for receiving said retail edge markers from said source and forming a series of sets;

a graduated lift mechanism configured to lift each of said series of sets of retail edge markers to different heights above said support member such that said series of sets of retail edge markers are separated by a predetermined height;

a pusher configured for movement orthogonally to said support member in order to collect and collate said series of sets of retail edge markers into a collated stack, and wherein said pusher has integrated shelves that correspond to each graduation of said graduated lift mechanism.

9. The collating system of claim 8, wherein at the end of said movement of said pusher said series of sets of retail edge markers are held on each of said shelves now one on top of the other.

10. The collating system of claim 9, wherein said pusher includes an actuator and wherein said actuator when actuated retracts said shelves and thereby drops said series of sets of retail edge markers to form one collated stack.

11. The collating system of claim 10, wherein said graduated lift mechanism includes stair shaped members.

12. The collating system of claim 9, wherein said graduated lift mechanism includes step shaped members.

13. A method for collating media strips exiting a source, comprising:

providing a receiver configured to receive said media strips from said source and position them thereon in a series of individual bundles;

providing lift guides and lifting each of said series of individual bundles of media strips to a height above said receiver;

providing a pusher with integrated shelves and configured for movement orthogonally to said individual bundles of media strips;

using said pusher to move said individual bundles of media strips off said lift guides to said height above said receiver;

removing said pusher from beneath said individual bundles of media strips and dropping said individual bundles of media strips; and providing a collection station adapted to receive said media strips from said pusher after said pusher has been removed from beneath said individual bundles of media strips.

14. The method of claim 13, including providing said lift guides in a stepped profile.

15. The method of claim 13, including providing said lift guides with a graduated profile.

16. The method of claim 13, including providing said integrated shelves to correspond to said graduated profile of said lift guides.

17. The method of claim 16, including providing an actuator that retracts said pusher at the end of its push and thereby causing said individual bundles of media strips to drop and form a compiled collated stack.

* * * * *